US006092303A

United States Patent [19]

Piccinino, Jr. et al.

[11] Patent Number: 6,092,303

[45] Date of Patent: Jul. 25, 2000

[54] APPARATUS AND METHOD FOR DRYING PHOTOSENSITIVE MATERIAL USING RADIANT SECTION AND AN AIR FLOW SECTION

[75] Inventors: Ralph L. Piccinino, Jr., Rush; Kevin H. Blakely, Rochester; Daniel C. Davis, Rush; Raymond E. Wess, Holley, all of N.Y.

[73] Assignee: Eastman Kodak Company, Rochester, N.Y.

[21] Appl. No.: 09/092,841

[22] Filed: Jun. 5, 1998

[51] Int. Cl.[7] ..... F26B 7/00

[52] U.S. Cl. ..... 34/421; 34/423

[58] Field of Search ..... 34/420, 421, 423, 34/418, 637, 643, 273

[56] References Cited

U.S. PATENT DOCUMENTS 3,364,062 1/1968 Mitchell et al. ..... 117/93.31

4,324,479 4/1982 Sachs ..... 354/319

4,936,025 6/1990 Heikkila ..... 34/18

*Primary Examiner*—Henry Bennett

*Assistant Examiner*—Malik N. Drake

*Attorney, Agent, or Firm*—Frank Pincelli

[57] ABSTRACT

A drying apparatus and method utilizes the combination of radiant heat and air to quickly dry photosensitive material. The arrangement of the drying apparatus is such that radiant heat is first applied to photosensitive material at a radiant heat application section to substantially dry the photosensitive material without emulsion side contact and, thereafter, an air flow is directed onto both sides of the photosensitive material after it leaves the radiant heat application section. A plurality of air flow nozzles are used to direct the air onto the photosensitive material with the nozzles being oriented so as to direct air away from the radiant heat application section of the drying apparatus. This provides for an efficient and quick drying of photosensitive material in a compact unit.

12 Claims, 2 Drawing Sheets

APPARATUS AND METHOD FOR DRYING PHOTOSENSITIVE MATERIAL USING RADIANT SECTION AND AN AIR FLOW SECTION

FIELD OF THE INVENTION

The present invention relates to the field of photoprocessing, and more particularly, to an apparatus and method for drying photosensitive material.

BACKGROUND OF THE INVENTION

When drying photosensitive material such as processed photosensitive material, photographic prints, cut sheets or film, the photosensitive material is traditionally conveyed through a dryer by way of guides and/or rollers which contact the photosensitive material. During drying of the photosensitive material it is beneficial that the drying takes place in a rapid manner and that any contact on an emulsion side of the photosensitive material be minimized. By minimizing contact between the emulsion side of the photosensitive material and the guides and/or rollers, distortions or damage to the photosensitive material is decreased.

U.S. Pat. No. 3,973,328 discloses the use of radiant heat and forced air during the drying of photographic sheets. In this document the air flow is a cool air flow which is maintained between 20° C. and 40° C. and assists in cooling down rollers located on each side of a radiant heating bar arrangement.

U.S. Pat. No. 4,257,172 discloses a combined forced air and infrared dryer. The dryer of the U.S. Pat. No. 4,257,172 is primarily for removing vaporous substances such as paints, adhesives, and moisture from a product. Therefore, in U.S. Pat. No. 4,257,112, the product is first introduced by way of a conveyor belt below ventilating nozzles which provide gases onto the product to remove moisture and other vaporous substances from the product. Thereafter, the product is conveyed below an array of heaters which also include ventilating passages to remove a vapor barrier.

SUMMARY OF THE INVENTION

The present invention is directed to a novel apparatus and method for drying a photosensitive material in which the photosensitive material is first subjected to heating from both sides in a radiant heating section by way of radiant heating bars. The photosensitive material is thereafter conveyed to an air flow application section where the photosensitive material is subjected to a heated air flow from both sides to finalize the drying of the photosensitive material. In the arrangement of the present invention, the heated air flow is supplied by air flow nozzles which are oriented in a manner to direct the air flow away from the radiant heating bar arrangement. Therefore, the supplied air flow does not adversely effect the heating provided by the radiant heating bar arrangement. Furthermore, the heated air flow permits an efficient and quick final drying of the photosensitive material in the air flow application section.

The method and apparatus of the present invention is beneficial when drying processed photosensitive material onto which has been applied a solution of a predetermined viscosity, such as shown in for example, co-pending applications 08/975,560, 08/965,639 and 08/965,105, the subject matter of which is herein incorporated by reference. With the system and method of the present invention, the initial application of radiant heat does not distort the applied solution and provides for an even drying of the solution.

After the photosensitive material and the applied solution is dried to a specific state, it is transferred to the air flow application section, which achieves a final drying of the photosensitive material and solution applied thereon. Due to the initial application of radiant heat, the heated air flow applied to the photosensitive material will not distort or damage the applied solution on the photosensitive material.

Of course, the present invention is not limited to drying processed photosensitive material having an applied solution thereon as described above, and is also applicable to drying cut sheets, webs or any type of product which is desired to be dried in a quick and efficient manner; while at the same time, not disturbing the surface of the product or touching the emulsion side of photosensitive material.

The present invention relates to an apparatus for drying photosensitive material which comprises a radiant heating bar arrangement for applying radiant heat to photosensitive material so as to substantially dry the photosensitive material; and at least one air flow nozzle provided downstream of the radiant heating bar arrangement with respect to a conveying direction of the photosensitive material. The at least one air flow nozzle directs an air flow onto the photosensitive material so as to provide for a final drying of the photosensitive material.

The present invention also relates to a method of drying photosensitive material which comprises the steps of applying radiant heat to a photosensitive material at a radiant heat application section to substantially dry the photosensitive material; and directing an air flow onto the photosensitive material at an air flow application section located downstream of the radiant heat application section and after the step of applying radiant heat to the photosensitive material, so as to provide for a final drying of the photosensitive material.

The present invention also relates to a photoprocessing system which comprises a processing assembly for processing photosensitive material; and a drying apparatus for drying the processed photosensitive material. The drying apparatus comprises a radiant heating bar arrangement for applying radiant heat to the processed photosensitive material to substantially dry the processed photosensitive material, and at least one air flow nozzle provided downstream of the radiant heating bar arrangement with respect to a conveying direction of the processed photosensitive material. The at least one air flow nozzle directing an air flow onto the processed photosensitive material so as to provide for a final drying of the processed photosensitive material.

The present invention also relates to a photoprocessing method which comprises the steps of processing a photosensitive material at a photosensitive material processing section; applying radiant heat to the processed photosensitive material at a radiant heat application section to substantially dry the processed photosensitive material; and directing an air flow onto the processed photosensitive material at an air flow application section located downstream of the radiant heat application section and after the step of applying radiant heat to the processed photosensitive material, so as to provide for a final drying of the processed photosensitive material.

DETAILED DESCRIPTION OF THE INVENTION

Figure 1:
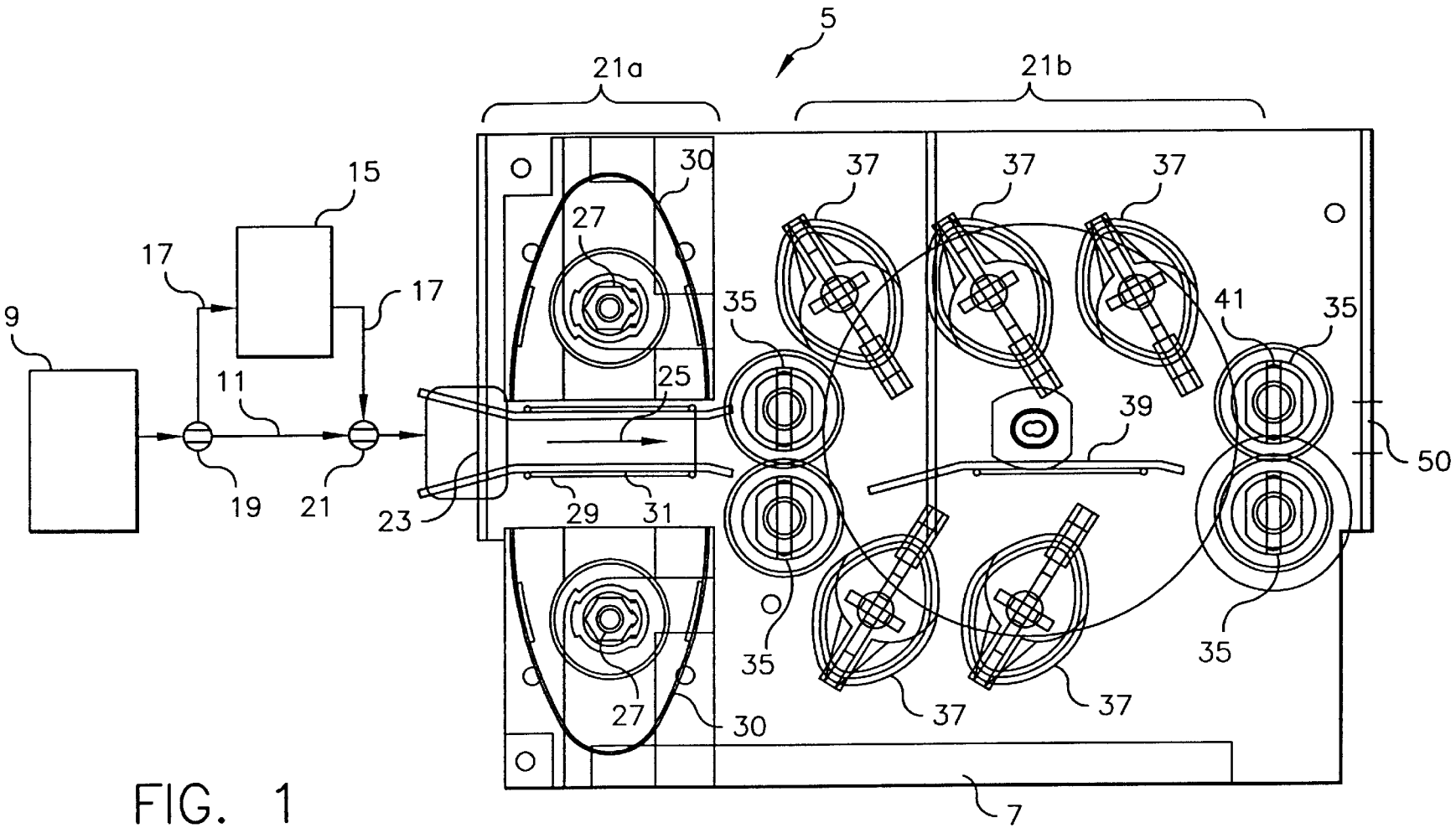
FIG. 1 is a schematic illustration of a photoprocessing system in accordance with the present invention, including the drying apparatus of the present invention.

Referring now to the drawings, wherein like reference numerals represent identical or corresponding parts throughout the illustrated Figures, FIG. 1 schematically illustrates a photoprocessing system 5 as well as a drying apparatus 7 of the present invention.

As illustrated in FIG. 1, drying apparatus 7 can receive photosensitive material which exits a processing assembly 9 by way of conveying path 11. Processing assembly 9 can be part of a processing section and can be a known assembly which includes a series of processing tanks. Each of the processing tanks can include, for example, developer solution, fixing solution, bleaching solution, washing solution, etc. Each processing tank represents a different step in the processing of photosensitive material. As a further option, a coating apparatus 15 can be provided in conveying path 11 downstream of processing assembly 9, or can be provided in a bypass line 17 as shown in FIG. 1, for selective coating of processed photosensitive material leaving processing assembly 9.

For example, in one embodiment, processed photosensitive material exiting processing assembly 9 can directly enter drying apparatus 7 of the present invention. As a further embodiment, coating apparatus 15 can be positioned on conveying path 11 so as to apply a solution of predetermined viscosity onto the processed photosensitive material prior to entering drying apparatus 7. With respect to coating apparatus 15, this could be any type of coating apparatus which provides a solution onto the processed photosensitive material. For example, coating apparatus 15 could be an apparatus which provides a solution of predetermined viscosity onto the processed photosensitive material such as disclosed in co-sending U.S. application Ser. Nos. 08/975,560, 08/965,639 and 08/965,105. As a further embodiment, coating apparatus 15 can be positioned in a bypass line 17 as shown in FIG. 1. Through the use of diverters 19,21 and bypass line 17, the processed photosensitive material can be selectively lead into coating apparatus 15 and thereafter into drying apparatus 7, or the processed photosensitive material can be directly lead from processing assembly 9 to drying apparatus 7.

As explained above, drying apparatus 7 is beneficial in drying photosensitive material which has been coated with solution since drying apparatus 7 is effective to quickly dry the photosensitive material without disturbing the emulsion side and/or coating applied on the photosensitive material. This is just an example for utilizing drying apparatus 7 of the present invention, and it is recognized that drying apparatus 7 is not limited to drying photosensitive material having a solution applied thereon, and it also not limited to being utilized downstream of a coating apparatus or a processing assembly. Drying apparatus 7 can be used as part of an existing processing system, can be built into a processing system, can be added on as a accessory or can be used as a stand alone unit. Also, drying apparatus 7 is applicable to dry any type of photosensitive material, photographic print, cut web or sheet, or any type of paper product in which drying is desired while minimizing distortions. Drying apparatus 7 can also be positioned at various locations of a processing system where drying is desired.

As illustrated in FIG. 1, drying apparatus 7 includes a radiant heat application section 21*a* located in a vicinity of an entrance 23 of drying apparatus 7, and an air flow application section 21*b* located downstream of radiant heat application section 21*a* with respect to a conveying direction 25 of photosensitive material. Radiant heat application section 21*a* of dryer 7 includes radiant heating bars 27 located on both sides of photosensitive material conveying path 29, which extend transversely with respect to conveying direction 25. Each radiant heating bar 27 include a reflective cover 30 which is preferably parabolic and is effective to direct radiant heat in a direction toward photosensitive material conveying path 29. Therefore, as photosensitive material enters into drying apparatus 7 through entrance 23, the photosensitive material is first subjected to radiant heat from opposite sides from heating bars 27, which quickly and substantially dry the photosensitive material. This specific arrangement is effective to minimize any distortion to an emulsion side of the photosensitive material, and is especially effective in the event the photosensitive material includes an applied coating, since it will quickly dry the coating as well as the underlying photosensitive material without any touching or distortion.

A guiding arrangement 31 is located in radiant heat application section 21*a*. Guiding arrangement 31 guides the photosensitive material through radiant heat application section 21 and to a first drive roller pair 35. Drive roller pair 35 conveys the photosensitive material into air flow application section 21*b*. Air flow application section 21*b* includes a plurality of air nozzles 37 positioned on opposite sides of a photosensitive material guide member 39. Air nozzles 37 supply heated air, which has been heated in a known manner, onto both sides of photosensitive material as it passes through guide member 39. This permits a final drying of the photosensitive material and if applicable a coating solution applied to the surface of the photosensitive material.

Therefore, with the arrangement of the present invention, the photosensitive material is first subjected to radiant heat in radiant heat application section 21*a* by the way of heating bars 27 so as to achieve a substantial drying of the photosensitive material without distorting the surface of the photosensitive material. This is especially effective in situations in which the photosensitive material has a coating solution applied thereon. After the photosensitive material exits radiant heat application section 21*a*, it is conveyed to air flow application section 21*b*, where a heated air flow is applied on both sides by way of air flow nozzles 37; since the photosensitive material has already been subjected to radiant heat in radiant heat application section 21*a*, air flow nozzles 37 provide for a final drying of the photosensitive material without distorting the photosensitive material and without emulsion side contact. Additionally, with the specific arrangement of the present invention, a rapid drying can be achieved through the use of a compact unit.

Figure 2:
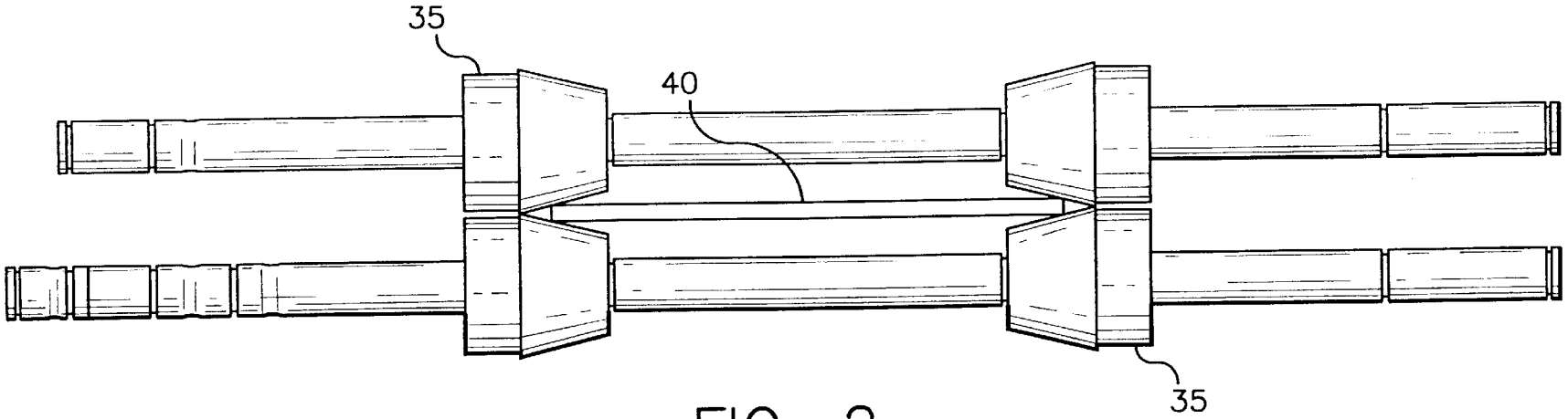
FIG. 2 is a representative example of drive roller pair which can be utilized within the drying apparatus of the present invention.

As further shown in FIG. 1, drive roller pair 35 conveys the photosensitive material from radiant heat application section 21*a* to air flow application section 21*b*. In situations where the photosensitive material being dried is a photosensitive material having a coating solution applied thereon, drive roller pair 35 could be an approximately V-shaped roller pair as illustrated in FIG. 2. This type of drive roller pair arrangement permits the conveyance of photosensitive material 40, as shown in FIG. 2, while only touching the side edges of photosensitive material 40. This is especially effective when drying photosensitive material having a coating solution applied thereon and adds to the efficiency of drying apparatus 7 of the present invention.

With the arrangement of the of the present invention, the photosensitive material will (1) be subject to radiant heat without emulsion side contact (2) be conveyed by drive roller pair 35 as illustrated in FIG. 2 which does not touch the emulsion side of photosensitive material 40; and (3) thereafter transferred to air flow application section 21*b*, where heated air is applied on both sides. The heated air is preferably in the range of approximately 150–200° F. which can be heated in a conventional way and supplied to dryer apparatus by way of a known air blower and duct arrangement (not shown).

It is noted that the configuration of drive roller pair 35 is not limited to the approximately V-shape shown, and can be other shapes depending on the type of material which is to be dried. For example, drive roller pair 35 could be conventional rollers which have a non-stick surface such as a teflon surface. This type of arrangement can be applied in situations where some degree of emulsion side contact can be tolerated.

As further illustrated in FIG. 1, each of air flow nozzles 37 are oriented at an angle with respect to a line which is perpendicular to conveying direction 25. More specifically, each of air flow nozzles 37 are oriented so as to direct air flow away from radiant heat application section 21*a* and thereby away from heating bars 27. With this type of arrangement, the air flow from nozzles 37 will not be directed toward a vicinity of heating bars 27 and thereby will not achieve an unwanted cooling of heating bars 27.

Figure 3:
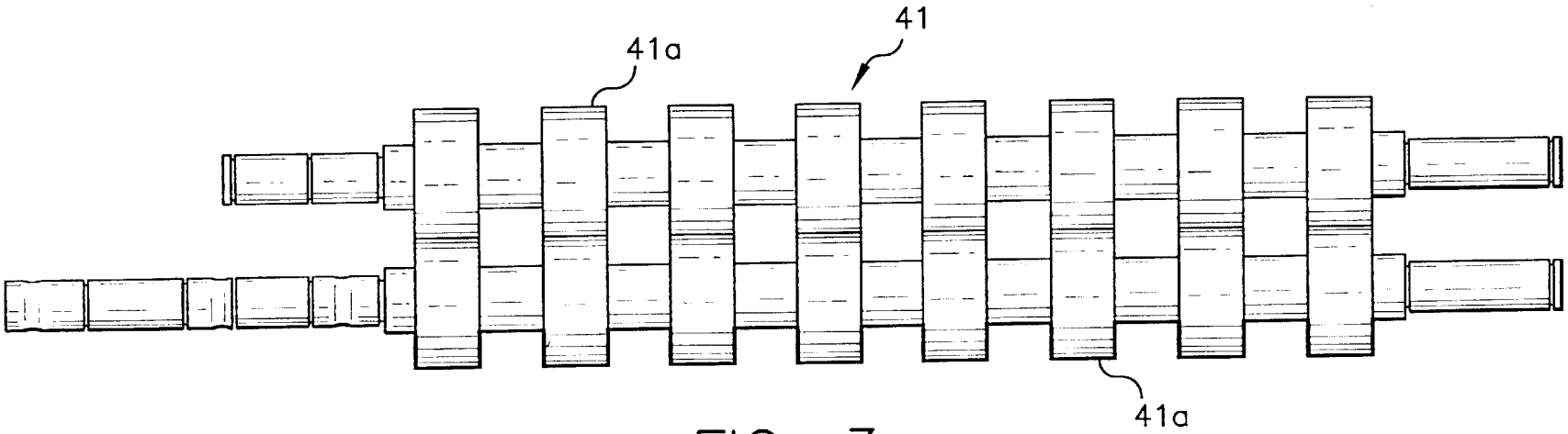
FIG. 3 is a further example of a drive roller pair which can be utilized within the drying apparatus of the present invention.

After the photosensitive material is conveyed through air flow application section 21*b*, it is conveyed by way of drive roller pair 41 to an exit 50 of drying apparatus 7. A preferred embodiment of drive roller pair 41 for maximizing the operation of drying apparatus 7 is illustrated in FIG. 3. That is, as shown in FIG. 3, drive roller pair 41 can be composed of opposing segmented rollers 41*a*. The use of segmented rollers 41*a* permits an air flow through the rollers in view of the respective orientation of air flow nozzles 37 in a direction approximately in conveying direction 25 and away from radiant heat application 21*a*. The use of segmented rollers 41*a* as illustrated in FIG. 3 prevents too much moisture from building up inside drying apparatus 7, and permits an efficient and quick drying of photosensitive material.

Therefore, the present invention provides for a compact drying apparatus 7 which can be placed downstream of a processing assembly as an added-on accessory, can be built into an existing processor or is functional as a stand-alone unit. Drying apparatus 7 further permits a quick and efficient drying of both sides of a photosensitive material without emulsion side contact and can dry a web of photosensitive material or cut sheets.

The invention has been described in detail with particular reference to certain preferred embodiments thereof, but it will be understood that variations and modifications can be effected within the spirit and scope of the invention.

What is claimed is:

1. An apparatus for drying photosensitive material, the apparatus comprising:

a radiant heating bar arrangement for applying radiant heat to photosensitive material so as to substantially dry the photosensitive material; and a plurality of air flow nozzles provided downstream of said radiant heating bar arrangement with respect to a conveying direction of the photosensitive material and disposed on opposite sides of a photosensitive material conveying path, all of said air flow nozzles being orientated so as to direct heated air flow onto both sides of said photosensitive material and in a direction away from said radiant heating bar arrangement so as to provide for a final drying of the photosensitive material.

2. An apparatus according to claim 1, wherein said radiant heating bar arrangement is located in a vicinity of an entrance of said apparatus and comprises heating bars disposed on opposite sides of a photosensitive material conveying path, each of said heating bars comprising a reflective cover for directing radiant heat onto both sides of said photosensitive material as said photosensitive material passes through said photosensitive material conveying path in said conveying direction.

3. An apparatus according to claim 1, further comprising:

a first drive roller pair located at a photosensitive material conveying path and between said radiant heating bar arrangement and said at least one air flow nozzle; and a second drive roller pair located at said photosensitive material conveying path and between an exit of said apparatus and said at least one air flow nozzle.

4. An apparatus according to claim 3, wherein said first drive roller pair comprises approximately V-shaped rollers and said second drive roller pair comprises segmented rollers.

5. An apparatus according to claim 3, wherein said first drive roller pair comprises rollers having a non-stick surface and said second drive roller pair comprises segmented rollers.

6. A method of drying photosensitive material, the method comprising the steps of:

applying radiant heat to a photosensitive material at a radiant heat application section to substantially dry the photosensitive material; and angling a plurality of air flow nozzles so that all of said air flow nozzles direct a heated air flow onto both sides of said photosensitive material in a direction away from said radiant heat application section at an air flow application section located downstream of said radiant heat application section and after said step of applying radiant heat to said photosensitive material, so as to provide for a final drying section of said photosensitive material.

7. A method according to claim 5, wherein said step of applying radiant heat to said photosensitive material comprises applying said radiant heat onto both sides of said photosensitive material.

8. A photoprocessing system comprising:

a processing assembly for processing photosensitive material; and a drying apparatus for drying said processed photosensitive material, said drying apparatus comprising a radiant heating bar arrangement for applying radiant heat to said processed photosensitive material to substantially dry said processed photosensitive material, and at least one air flow nozzle provided downstream of said radiant heating bar arrangement with respect to a conveying direction of the processed photosensitive material, all of said at least one air flow nozzle directing a heated air flow onto said processed photosensitive material so as to provide for a final drying of said processed photosensitive material, said radiant heat bar arrangement comprises heating bars disposed on opposite sides of a photosensitive material conveying path so as to provide radiant heat to both sides of said processed photosensitive material, and said drying apparatus comprises of a plurality of said air flow nozzles disposed on opposite sides of said photosensitive material conveying path which direct heated air flow onto both sides of said photosensitive material.

9. A photoprocessing system according to claim 8, wherein said at least one air flow nozzle is oriented so as to direct said air flow in a direction away from said radiant heating bar arrangement.

10. A photoprocessing method comprising the steps of:

processing a photosensitive material at a photosensitive material processing section;

applying radiant heat to said processed photosensitive material at a radiant heat application section to substantially dry the photosensitive material; and angling a plurality of air flow nozzles so that all of said air flow nozzles direct a heated air flow onto both sides of said processed photosensitive material in a direction away from said radiant heat application section at an air flow application section located downstream of said radiant heat application section and after said step of applying radiant heat to said processed photosensitive material, so as to provide for a final drying of said processed photosensitive material.

11. A photoprocessing method according to claim 10, wherein said step of applying radiant heat to said processed photosensitive material comprises applying said radiant heat onto both sides of said processed photosensitive material.

12. An apparatus for drying photosensitive material, the apparatus comprising:

a radiant heating bar arrangement for applying radiant heat to photosensitive material so as to substantially dry the photosensitive material;

at least one air flow nozzle provided downstream of said radiant heating bar arrangement with respect to a conveying direction of the photosensitive material, all of said at least one air flow nozzle directing a heated air flow onto said photosensitive material so as to provide for a final drying of said photosensitive material;

a first drive roller pair located at a photosensitive material conveying path and between said radiant heating bar arrangement and said at least one air flow nozzle; and a second drive roller pair located at said photosensitive material conveying path and between an exit of said apparatus and said at least one air flow nozzle.

* * * * *